United States Patent [19]

Parker

[11] 4,195,378

[45] Apr. 1, 1980

[54] MULTIPURPOSE BEACH EQUIPMENT

[76] Inventor: James J. Parker, 23011 Lita Pl., Woodland Hills, Calif. 91364

[21] Appl. No.: 954,181

[22] Filed: Oct. 24, 1978

[51] Int. Cl.[2] ..... A47G 9/06

[52] U.S. Cl. ..... 5/419; 190/2

[58] Field of Search ..... 190/1, 2; 5/344, 419, 5/417, 418, 420; 150/52 R; 224/49

[56] References Cited

U.S. PATENT DOCUMENTS

| | | | |
|---|---|---|---|
| 1,175,024 | 3/1916 | Thorson | 224/49 |
| 1,217,357 | 2/1917 | Sparrow | 150/52 R |
| 1,222,563 | 4/1917 | Rosenberg | 5/344 |
| 1,237,243 | 8/1917 | Conner | 5/344 |
| 2,038,335 | 4/1936 | Aronow | 5/344 X |
| 2,264,471 | 12/1941 | Glenn | 5/344 |
| 2,812,123 | 11/1957 | Girton | 224/49 X |
| 2,870,464 | 1/1959 | Lalick | 5/344 X |
| 3,041,638 | 7/1962 | Lo Vico | 190/2 X |
| 3,082,437 | 3/1963 | Upthagrove | 5/419 |
| 4,097,944 | 7/1978 | Yulish | 5/419 |
| 4,101,994 | 7/1978 | Hoyt | 5/344 |

FOREIGN PATENT DOCUMENTS

| | | | |
|---|---|---|---|
| 551155 | 1/1923 | France | 224/49 |
| 1044391 | 6/1953 | France | 5/344 |
| 1407484 | 9/1975 | United Kingdom | 190/2 |

*Primary Examiner*—Donald F. Norton

*Attorney, Agent, or Firm*—Poms, Smith, Lande & Rose

[57] ABSTRACT

An oversize, heavy duty beach towel is provided with sealable pockets at one end. The pockets are located so as not to interfere with the use of the towel for drying oneself off after swimming or for reclining. The pockets are designed to enclose various items that may be brought to the beach. One of the pockets is larger than the others, and is located at the middle of one end of the towel to facilitate its use as a pillow when filled with soft, bulky material. Waterproof zippers and linings protect the contents of the pockets from moisture. The towel unit includes a removable handle to be used for retaining the towel and its contents in a convenient package when the towel is rolled or folded.

2 Claims, 4 Drawing Figures

MULTIPURPOSE BEACH EQUIPMENT

FIELD OF THE INVENTION

This invention relates to multipurpose beach or recreational equipment.

BACKGROUND OF THE INVENTION

Enjoying a comfortable day at the beach involves overcoming a number of logistical problems. First, a good deal of paraphernalia must be brought to the beach, such as beach towels, pillows, cameras, and purses. Second, one is faced with having to find methods of concealing one's valuables while swimming, of avoiding the loss of important items, like car keys, in the sand, and of protecting delicate items, like cameras, from the elements. Finally, one must collect and repack all of the items for the trip home from the beach.

Up to the present time, no item of beach equipment has been available which would simultaneously provide the beach-goer with a means to transport items to the beach, to lie on, to dry oneself off after swimming, and to protect valuables from theft and the elements.

Accordingly, it is a principal object of this invention to facilitate the transport of the beach-goer's items to the beach.

It is a further object of this invention to aid the beach-goer, while at the beach, in concealing valuables, in protecting various other items from loss, and in isolating delicate objects from the elements.

It is a final object of the invention to increase the enjoyment of the beach-goer through the provision of one piece of beach equipment to perform the above functions of transporting and protecting the items he brings to the beach, as well as to dry off with and to comfortably recline upon while at the beach.

SUMMARY OF THE INVENTION

The present invention involves, in one illustrative embodiment, the provision of a combined suitcase, lounging or sleeping pad and towel, including a sheet of heavy toweling material, such as terry cloth, which has a plurality of storage pockets incorporated into one end. The sheet is larger in size than the average beach towel to enable it to be used as a combination drying towel and beach lounging and sleeping pad. The particular location of the pockets is such that one has unimpeded use of the towel for reclining or for drying oneself after swimming.

The storage pockets provided are of two sizes. One large pocket is provided at the center of one end of the towel. This pocket is large enough to allow its use as a pillow when filled with soft, bulky material. This pillow-forming capability enhances the towel's use as beach lounging and sleeping pad. Between the large pocket and the edges of the towel are a plurality of smaller pockets. These pockets can be used, as is the case with the larger pocket, to store various items brought to the beach which might otherwise be left in the open or might necessitate bringing separate storage elements for them. Use of the storage pockets, therefore, not only results in not having to bring certain items to the beach, such as purses and pillows, but also facilitates the concealment of valuables, the protection of delicate or light-sensitive items, and the retention of items which otherwise could get lost in the sand.

In accordance with another feature of the invention, a removable handle strap may be provided. The strap is not only used to retain the towel and its contents in one compact package when the towel is rolled up, but also is used to carry the resulting package. Use of the towel and its handle thus provides a convenient method of carrying items to the beach.

A further aspect of the invention involves the use of waterproof zippers to seal the storage pockets. This feature helps to protect the contents of the storage pockets from moisture.

In accordance with still another aspect of the invention, the storage pockets contain waterproof linings. These linings also help to protect the contents of the pockets from moisture.

Other features and advantages will become apparent from a consideration of the following detailed description and of the appended drawings.

DETAILED DESCRIPTION

Figure 1:
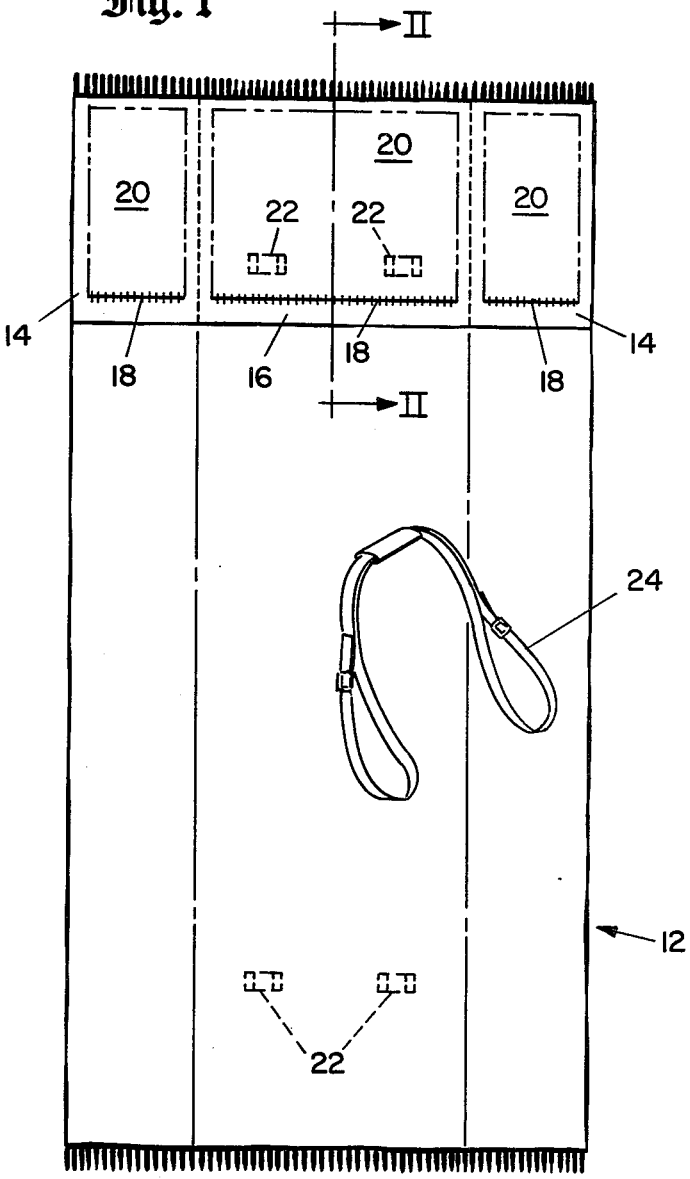
FIG. 1 is a top view of the combined towel, beach lounging and sleeping pad, and suitcase along with its accompanying handle strap.

Referring now to FIG. 1, a large sheet of toweling material 12, approximately 7 feet in length by 3½ feet in width, is provided. The towel is constructed of soft but heavy duty material, such as terry cloth.

At one end of the towel are located two small storage pockets 14, each approximately 18 inches long by 10 inches wide, and one large pocket 16 approximately 18 inches long by 22 inches wide. The pockets are made of the same material as is the towel and are formed by sewing an additional piece of the toweling material to the towel.

Each pocket 14 and 16 is sealed by a waterproof zipper 18 and has a waterproof lining 20 to protect the contents of the pocket from moisture.

Two pairs of fasteners 22 are provided on the backside of the towel 12. These fasteners allow a removable handle 24 to be attached to the towel 12 when the towel is rolled up either toward the end containing the pockets or toward the end opposite the pockets. The fasteners 22 may include a strap sewed onto the toweling material, and may have a snap or Velcro pad removably holding one end of each strap in place.

Figure 2:
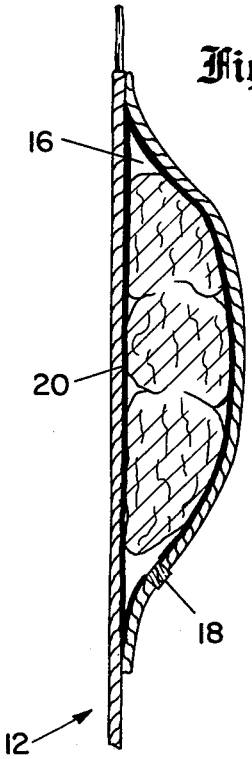
FIG. 2 is a cross-sectional view of the end of the towel, taken along the center of the large pocket in an orientation parallel with the longitudinal edge of the towel, showing the use of the large pocket as a pillow.

FIG. 2 shows a cross-sectional view of the large pocket 16 in the towel 12. The waterproof zipper 18 is preferably located at the edge of the pocket and may be located at the edge of the pocket closest to the center of the towel. The zipper 18 provides a sealable access into the interior of the storage pocket 16. Within the pocket is a lining 20 which may be made of canvas or plastic material. The pocket 16 is of sufficient volume to allow enough soft, bulky items to be inserted into it to form the pocket into a pillow for use when one is lounging or reclining upon the towel. When the pocket 16 is empty, it and its lining 20 lie flat.

Figure 3:
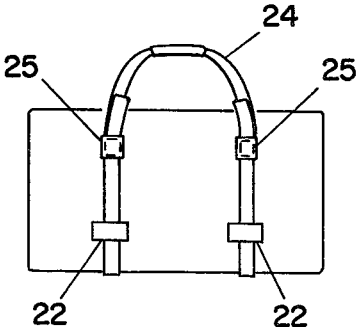
FIG. 3 is a side view of the towel and its accompanying handle strap when the towel is rolled up for carrying.

FIG. 3 shows the orientation of the removable handle strap 24 and the fasteners 22 upon the rolled towel 12. As discussed above, there are two pairs of fasteners 22, one pair of which will be exposed depending on the direction in which the towel 12 is rolled or folded. The handle strap 24 passes through the fasteners 22 and completely around the greater portion of the circumference of the rolled or folded towel. The handle strap 24 supports the towel in two locations to provide a uniform distribution of the weight of the towel and its contents, thereby making the towel and its contents easier to carry. The handle strap may be constructed of any material sufficient to support the towel and its contents, such as canvas, plastic, or heavy toweling material. As mentioned, the handle fasteners 22 include a small strap fixedly fastened at one end to the towel 12. The other ends of the fasteners 22 are open to allow the handle strap 24 to be passed beneath them. Once the handle strap 24 is in position, the free ends of the fasteners 22 are secured to the towel by snaps, Velcro pads, or similar devices. Alternatively the handle strap may be adjustable by the use of buckles 25; and when such adjustments are provided, the fasteners 22 may be dispensed with.

Figure 4:
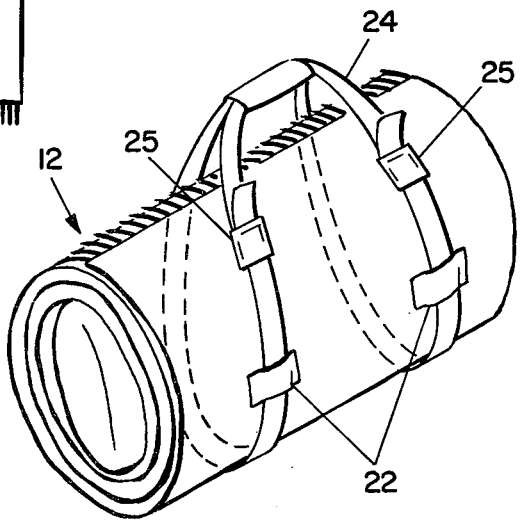
FIG. 4 is an isometric view of the rolled towel and its handle strap.

FIG. 4 is an isometric view of the rolled towel 12, handle strap 24, and fasteners 22 shown in FIG. 3. As can be seen, when the towel is rolled toward the end opposite the pockets, the pockets and their contents are located in the center of the package. In this manner, sufficient cushioning is provided to protect the delicate items in the pockets from shock and vibration. Alternatively, when the towel is folded up from the end away from the pockets, easier access is provided to retrieve objects from the pockets.

The particular invention described above is in contrast to products which are available. Known prior arrangements include specialty hand and traveling bags, which are generally adapted to carrying a small quantity of items, and sleeping bags which are adapted to be carried by straps. No products are known to be available which have multiple uses as a towel, lounging pad, and suitcase.

In the foregoing description of the present invention, a preferred embodiment of the invention has been disclosed. It is to be understood that other mechanical and design variations are within the scope of the present invention. Thus by way of example and not of limitation, the storage pockets could be placed in different locations around the periphery of the towel; a different number of storage pockets could be used; the zippers on the storage pockets could have a different orientation; the pockets could be of a different shape; and a permanent handle or backpack type supporting straps may be included in the assembly. Accordingly, the invention is not limited to the particular arrangement which is illustrated and described in detail.

What is claimed is:

1. A combined towel, beach lounging and sleeping pad, and suitcase, comprising:

an oversized, heavy-duty sheet of toweling material;

a continuous piece of toweling material attached to said sheet in a plurality of locations in a manner forming a large storage container substantially the size of a pillow at the center of one end of said toweling sheet for receiving and storing soft, bulky material and forming a plurality of additional individual storage containers on said toweling sheet, said additional containers being located toward the edges of said sheet to permit unimpeded use of said toweling sheet for reclining or for drying oneself after swimming;

waterproof zipper means for sealing said formed containers;

removable handle means for carrying said towel, said handle means encircling said combined towel in at least one location when said combined towel is rolled or folded up; and a plurality of snap means for releasably attaching said handle means to said sheet of toweling material.

2. An improved multipurpose beach towel equipment of the type having a substantially flat sheet of soft fabric of an extent at least equal to that of a large bath towel, wherein the improvement comprises:

a plurality of pocket means for enclosing various objects into said towel, said pocket means being incorporated along one end of said towel to permit unimpeded use of said towel for reclining or for drying oneself after swimming, said pocket means including a large pocket means, located in the center of the end of said towel, for enclosing soft, bulky objects to allow said large pocket means to be used as a pillow while one is reclining on said towel, and a plurality of small pocket means, located between said large pocket and said periphery of said towel, for enclosing other objects into said towel;

removable strap means for carrying said towel equipment, said strap means encircling said towel equipment in at least one location when said equipment is rolled or folded up; and a plurality of means for releasably attaching said strap means to said towel equipment.

* * * * *